United States Patent [19]

Dunsmore

[11] 4,224,771

[45] Sep. 30, 1980

[54] METHOD AND APPARATUS FOR REDUCING THE RATE OF HEAT TRANSFER

[76] Inventor: Howard L. Dunsmore, P.O. Box 13651, Reno, Nev. 89507

[21] Appl. No.: 928,866

[22] Filed: Jul. 28, 1977

[51] Int. Cl.[2] ..... E04B 1/62; E06B 7/02; E06B 7/12

[52] U.S. Cl. ..... 52/171; 52/173 R; 98/36; 165/1

[58] Field of Search ..... 52/171, 173; 165/53, 165/1; 98/36

[56] References Cited

U.S. PATENT DOCUMENTS

| | | | |
|---|---|---|---|
| 3,014,814 | 12/1961 | McConica | 52/171 X |
| 3,192,575 | 7/1965 | Rosenau, Jr. et al. | 52/171 |
| 3,233,423 | 2/1966 | Beckwith et al. | 98/36 X |
| 3,356,824 | 12/1967 | Rossetti | 52/171 |
| 3,502,020 | 3/1970 | Bressickello | 98/36 X |
| 3,524,044 | 8/1970 | Liardi | 52/171 X |
| 3,590,913 | 7/1971 | Tschudin | 52/171 X |
| 3,659,551 | 5/1972 | McKinstry | 98/36 |
| 3,874,441 | 4/1975 | Duchene | 165/1 |
| 3,925,945 | 12/1975 | White | 52/788 X |
| 3,932,971 | 1/1976 | Day | 52/171 |
| 3,990,201 | 11/1976 | Falbel | 52/171 |
| 4,024,726 | 5/1977 | Furner | 52/171 X |
| 4,076,374 | 2/1978 | Schwab | 52/171 X |

FOREIGN PATENT DOCUMENTS

| | | | |
|---|---|---|---|
| 507916 | 7/1920 | France | 52/171 |
| 481991 | 3/1938 | United Kingdom | 98/36 |

*Primary Examiner*—Alfred C. Perham
*Attorney, Agent, or Firm*—Schapp and Hatch

[57] ABSTRACT

A method and apparatus for reducing the rate of heat transfer between adjacent bodies, at least one of which is a body of fluid responsive to forces tending to move the fluid along the interface between the bodies, the fluid adjacent to the interface being more responsive to such forces by reason of heat transfer across the interface. The method collects fluid displaced along an expanse of the interface, transports the collected fluid to the other side of the expanse, and discharges it there for repeated displacement across the expanse to again be collected. The apparatus includes distributor and collector means at opposite sides of the expanse, and recirculating means for returning fluid from the collecting means to the distributor means. In some forms, the fluid body is air and the solid body is a thin sheet of thermally conductive material such as window panes used in buildings and transport craft. Heat flow through the pane from the air makes the boundary layer of air more dense, causing this layer to sink downwardly by force of gravity into the collector means, while heat transfer through the pane into the air causes the layer of air adjacent to the pane to rise into the collecting means. The window pane may be inclined or vertical. Where inclined, the pane is tilted at the top toward the cooler body. The apparatus is built in or retrofit, and is reversible to control heat flow in either direction.

64 Claims, 11 Drawing Figures

METHOD AND APPARATUS FOR REDUCING THE RATE OF HEAT TRANSFER

BACKGROUND OF THE INVENTION

1. Field of the Invention

The present invention relates to methods and apparatus for reducing the rate of heat transfer across an interface forming a common boundary for a fluid body and another body so as to reduce unwanted heat loss or heat gain from one body to another. Some aspects of the present invention relate more particularly to reducing heat transfer through windows or panels separating fluid bodies of differing temperatures.

2. Description of the Prior Art

Previous attempts to control heat transfer between adjacent bodies have most often employed heat insulating materials. Thermal insulation has also been accomplished by double wall construction having a vacuum therebetween. Likewise, multiple walls have been used to define spaces for "dead" (confined) air and/or other gases, or to provide paths for circulating various fluids to absorb and carry away a portion of the heat.

In the case of windows where light transmissibility must be maintained, utilization of low thermal conductivity materials as heat insulation is effectively precluded. The heat conductivity of glass and other transparent materials most commonly used for windows is not particularly high, but the path length is usually quite short. Accordingly, reduction of heat transfer through windows is particularly desirable. However, light transmissibility and transparency requirements heretofore have necessitated use of multiple pane/dead air, vacuum or removable fluid construction. For instance, it has been proposed to provide a reversible window having double pane, dead air construction with a third pane spaced therefrom and passages for entry of air at the bottom, and exit of air at the top, of the third pane from the space between the double panes and the third pane (See U.S. Pat. No. 3,925,945). In winter, the third pane faces the interior of the building, and in summer it faces the exterior. In this construction, natural convection between the double pane and the third pane is intended to absorb heat energy and conduct it to the outside air in summer, or into the building in the winter.

A typical dual pane window having a vacuum therebetween is shown in U.S. Pat. No. 3,990,201, and a multi-pane window having provision for flushing out the dead air space to eliminate moisture and condensation therein is shown in U.S. Pat. No. 3,932,971. A double pane window having water pumped through the space between the panes is shown in U.S. Pat. No. 4,024,726. A triple pane heat insulating window having a vacuum in one space between panes, and a forced flow of cooling fluid in the other space, is disclosed in U.S. Pat. No. 3,192,575. It therefore has been understood that unwanted heat transfer through windows can be reduced by adding more layers of glass at proper spacing, but this is quite expensive, especially for retrofit.

In winter, most of the heat passing through the window pane is lost to the air and this loss is greatly increased by natural convection. Air near the cold side of the window is heated by the glass, which reduces the density of such air, causing it to be forced upwardly by more dense air, which in turn approaches the pane, is heated, and the cycle repeats. Air near the warm side of a window is cooled and its density increases. The cool, dense air is pulled downwardly by gravity and warmer air replaces it. Again, this effect is repeated continually.

The flow of heat must be accounted for. When the outside air is cold and the inside air is warm, compensation for heat flow is accomplished by space heating. When the outside is warmer than the inside, heat flow compensation is accomplished by air conditioning.

SUMMARY OF THE INVENTION

The present invention contemplates use of a relatively simple method and structure for reducing the unwanted flow of heat by collecting the air flowing upwardly or downwardly along the window as a result of the described natural convection, and distributing the collected air to the window to again flow along the window by natural convection. The air flow is collected in a trough at the top or bottom of the window, depending upon whether the convection flow is upwardly or downwardly on that side of the window, and is then drawn from the trough through a tube by a small fan for return to a distributor at the opposite edge of the window from the collector trough. Here the air is again discharged next to the window. By this means, warmer than ambient air is returned to the window on the cold side and cooler than ambient air is returned to the window on the warm side. This reduces the temperature gradient across the window which in turn decreases the flow of heat. Some heat is still exchanged between the flowing air and the surrounding air, but this is less than the heat lost by unrestricted convection.

The invention is not restricted to air as the heat transfer (and absorbing) medium and recirculating fluid. It does, in fact, apply to any fluid in a force field, such as gravity, magnetism, electrical, centrifugal, centripetal, velocity changes, or otherwise to which the fluid is variably responsive in accordance with differences in temperature. Thus, the invention also applies to water tanks and to any other liquid or gas which is constrained at a boundary having an extent parallel to the lines of force.

The present application is also adapted for use with either one or both sides of a barrier interposed between two separate fluid bodies, and may be used on the fluid side of a barrier between a fluid and a vacuum.

The gravity responsive forms of the present invention are useful with vertical surfaces and with surfaces which are inclined between vertical and horizontal. For an inclined or vertical surface which is colder than the ambient adjacent fluid, the collector is positioned at the lower edge and the distributor is positioned at the upper edge. Conversely, if the inclined or vertical surface is warmer than the ambient temperature of the surrounding fluid, the collector is positioned at the higher edge and the distributor at the lower edge of the same surface. An inclined surface which is colder than the adjacent fluid should be tilted with its upper portions leaning away from the fluid so that the cooled, more dense liquid can run down the surface and not drop away from the surface, as would be the case if the upper edge of the surface were tilted toward the warmer fluid body. Likewise, where the fluid body is cooler than the surface, the upper edge of the surface should tilt toward the cooler body of fluid so that fluid of lesser density (caused by receiving heat from the surface) will rise against the surface and not be dissipated into the surrounding fluid, as would be the case were the upper edge of the surface tilted away from the cooler fluid. Intentional inclination of the interface or heat loss surface can result in greater control of heat transfer than would be possible for a vertically extending interface. The invention applies not only to plane surfaces, but also to single curved surfaces, compound curved surfaces, and to faceted surfaces as well.

The present invention is most useful in situations where the convecting fluid is not transported away from the constraining surface or interface by a motion of the fluid stronger than the convection motion. For example, where a collector and distributor assembly is installed on the outside of a vertical building window, at times the wind may tend to blow away the convection boundary layer adjacent to the window pane, rendering the device less effective. However, a collector and distributor assembly installed on the inside of such window will remain effective. Inclining the window, even a few degrees from the vertical, can cause the convection boundary layer on the outside of the window to press more closely to the surface of the window pane and thus at least partially avoid the wind effect.

The transport of the fluid from the collector to the distributor is not limited to mechanical motion induced by a fan. Such transport can be induced as well by a small jet of the fluid or by other means, whether from pressure forces or body forces. "Body forces" are those forces which act throughout the fluid, such as gravity, while "pressure forces" act on an element of fluid with transfer of force by molecular forces.

It often is desirable to manifold several collectors and/or distributors to a common fan. This construction may be desirable in installations of some horizontal length, because the physical restriction of fluid flow in a conduit tend to limit the useful length of single collectors and/or distributors.

It therefore is an object of the present invention to provide methods and apparatus for reducing the rate of heat transfer across an interface forming a common boundary for a fluid body and another body by collecting fluid displaced along an expanse of the interface in response to forces acting on the fluid body in the direction of the collection side of such expanse and discharging the collected fluid at the other side of the expanse; heat transfer through the interface increasing the effect of the described forces on the portion of the fluid body adjacent to the interface so as to displace the discharged collected fluid continuously across the expanse of interface for reducing the temperature gradient between the interface and the fluid body.

A further object of the present invention is to provide methods and apparatus of the character described wherein the interface is a common boundary between a fluid body and a solid body.

Another object of the present invention is to provide a method of reducing the rate of heat transfer from a heat loss surface to a fluid in contact therewith.

Another object of the present invention is to provide an apparatus of the character set forth in which the interface, or the heat loss surface, is provided by a barrier of relatively thin sheet material bounding or confining a fluid body.

A further object of the present invention is to provide an apparatus of the character described in which the interface, or the heat loss surface, is provided by a barrier, in the form of a relatively thin sheet of thermally conductive material, separating fluid bodies, and wherein the fluid of at least one of the fluid bodies changes in density in response to changes in temperature, the forces acting on the fluid body tending to vary in effect in accordance with the amount of heat transmitted to or from such fluid through the interface.

A still further object of the present invention is to provide apparatus of the character described in which the aforementioned force acting on the fluid is gravity whereby less force is exerted on less dense fluid and more force is exerted on increased density fluid in accordance with heat transfer to or from the fluid across the interface.

Another object of the present invention is to provide an apparatus of the character described which is adapted for use on both sides of a window or panel so as to reduce heat transfer to the window or pane from one side, and to reduce heat transfer from the window or panel to the other side.

Yet another object of the present invention is to provide an apparatus of the character set forth which is capable of being moved from a position reducing heat transfer from the air inside a building to the outside air, and an inverted or reversed position reducing heat transfer from the outside air to the air inside the building.

A further object of the present invention is to provide a window structure for spacecraft and high altitude aircraft capable of reducing the rate of heat transfer from the air in the interior of the craft to the outside of the craft.

Another object of the present invention is to provide a window construction for a vessel such as a ship, boat, submarine or the like, which is capable of reducing the rate of heat transfer from the interior of the vessel to the surrounding liquid.

A further object of the present invention is to provide an apparatus of the character described which is capable of operation on a varity of configurations of heat loss surfaces and in a variety of inclinations from the horizontal, including the vertical.

For a fuller understanding of the nature and objects of the present invention, reference should be had to the following detailed description and claims, taken in connection with the accompanying drawings.

While only the preferred forms of the invention have been illustrated in the accompanying drawings, it will be apparent that changes and modifications could be made thereto within the ambit of the invention as defined in the claims.

DETAILED DESCRIPTION OF THE PREFERRED EMBODIMENTS

The method of the present invention is adapted for reducing the rate of heat transfer across any interface forming a common boundary for a fluid body and another body, in which the fluid body is a liquid or gas constrained at the common boundary and acted upon by forces tending to move the fluid along an expanse of such interface, and wherein heat transfer through the interface either into the fluid body or away from the fluid body increases the effect of such forces on the portion of the fluid body adjacent to the interface so as to displace the layer of fluid adjacent the interface along such expanse. The displaced fluid is intercepted as it leaves the described expanse of interface and is returned to the other side of such expanse to again pass over the expanse of interface.

In this manner, the recirculating layer of fluid adjacent to the interface will have a temperature between that of the body of fluid and the temperature on the other side of the interface. Usually, the fluid will vary in density according to temperature. Therefore, if heat is passing through the interface into the fluid body, the boundary layer of fluid at the interface will receive the heat and expand to a lower density. Conversely, heat passing through the interface from the fluid body will result in a layer of fluid at the interface which is denser than the rest of the fluid body.

The forces acting on the fluid may be described as "body forces" or "pressure forces". Body forces act throughout the fluid, such as gravity or inertial forces, while pressure forces act on an element of fluid with transfer of force by molecular forces. Thus, gravitational forces will have a tendency to cause heated, less dense fluid to rise with respect to the body of fluid, while cooled, denser fluid will tend to sink.

Figure 1:
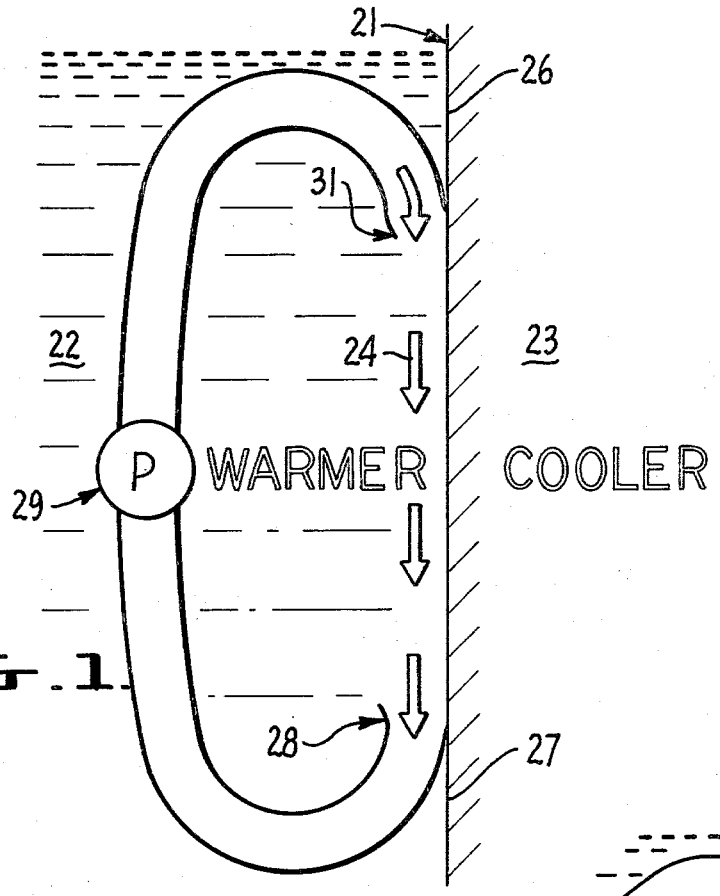
FIG. 1 is a diagramatic cross-sectional view of an interface forming a common boundary for a fluid body and another body illustrating fluid flow paths according to the present invention, the interface being shown in a vertical position.

FIG. 1 of the drawings schematically depicts a vertically extending interface 21 forming a common boundary between a warmer fluid body 22 and a cooler solid body 23. Arrows 24 indicate the flow path of fluid cooled by heat transfer away from fluid 22 through the interface 21. In this illustration, gravity causes the cooled layer of fluid adjacent interface 21 to sink from the upper edge 26 to the lower edge 27 of an expanse of interface 21. At 27, the sinking cooled fluid is intercepted and collected by collector means 28 and is returned as by pump means 29 to a distributor means 31 located at the upper edge 26 of the described expanse of interface.

As the cooled fluid recirculates along the path indicated by arrows 24, the temperature gradient across the interface is reduced, resulting in less flow of heat energy from the fluid body 22. Some heat energy is still exchanged between the downwardly flowing fluid and the surrounding fluid, but this is less than the heat lost by unrestricted convection. Were the sinking, cooled fluid not collected and recirculated in the manner described, it would merely sink to the bottom of the body of fluid and the temperature gradient across the interface would continue to be the differential between the average fluid temperature and the average temperature of the other side of the interface.

Where the body of fluid 22 is cooler than the solid body 23, the positions of the collector means 28 and distributor means 31 are reversed. The layer of fluid adjacent to interface 21 is heated and made less dense by heat energy transfered across interface 21 from solid body 23. Convection forces cause the layer of heated, less dense fluid to rise along interface 21, reducing the temperature gradient and consequently reducing heat transfer across the interface.

The described principle applies also to interfaces which are not parallel to the lines of force, but which are positioned in such manner that the boundary layer of heated or cooled fluid adjacent to the interface will move across an expanse of the interface under the influence of such forces. Thus, where gravity is the force acting on the fluid, the interface may be inclined from the vertical in the manner suggested in FIGS. 2 and 3 of the drawings.

Figure 2:
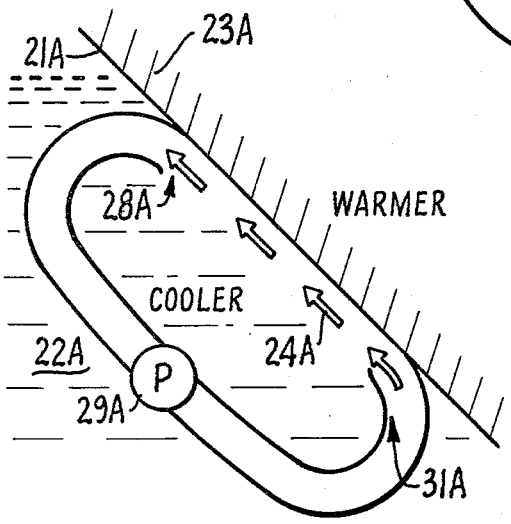
FIG. 2 is a diagramatic cross-sectional view similar to that of FIG. 1, but illustrating an inclined interface between a warmer solid body and a cooler liquid body.

FIG. 2 illustrates a typical orientation of an interface 21A between a cooler fluid body 22A and a warmer solid body 23A. The inclination may vary from the horizontal to the vertical, but the interface 21A should be tilted at the top in the direction of the cooler body of fluid 22A so that the boundary layer of less dense, heated fluid will follow the path indicated by arrows 24A, rising against the inclined interface 21A to be collected at 28A and returned via pump means 29A for distribution at 31A at the lower edge of the desired expanse of the interface. If interface 21A were tilted at the top away from the cooler body of fluid, the heated, less dense fluid would tend to rise away therefrom the interface, thus losing the described heat transfer reducing effect of the present invention.

Figure 3:
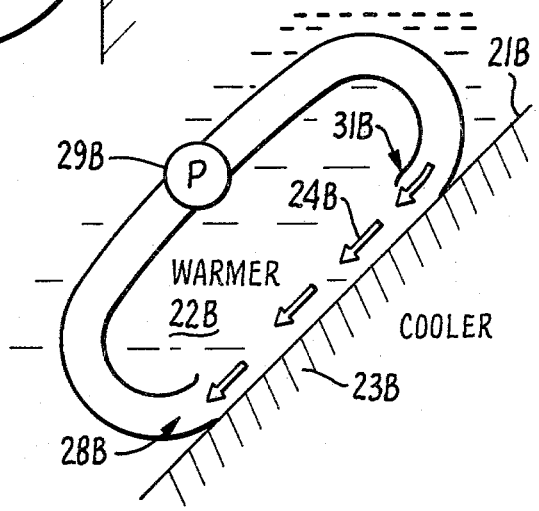
FIG. 3 is a diagramatic cross-sectional view similar to those of FIGS. 1 and 2, but illustrating an inclined interface between a cooler solid body and a warmer liquid body.

FIG. 3 illustrates a typical inclined interface 21B between a warmer fluid body 22B and a cooler solid body 23B. In this situation, the upper portion of the interface 21B is tilted away from the warmer fluid body 22B so that the boundary layer of cooled, denser fluid will follow the path illustrated by arrows 24B downwardly along the desired expanse of interface 21B. The downwardly moving cooled, denser fluid is collected at 28B and returned via pump means 29B to be distributed at 31B back onto the upper edge of the desired expanse of interface 21B. Were the upper portion of interface 21B to be tilted in the direction of the warmer body of fluid 22B, the cooled, denser fluid would tend to drop vertically away from the interface and not accomplish the reducing effect on heat transfer provided by the present invention.

Figure 4:
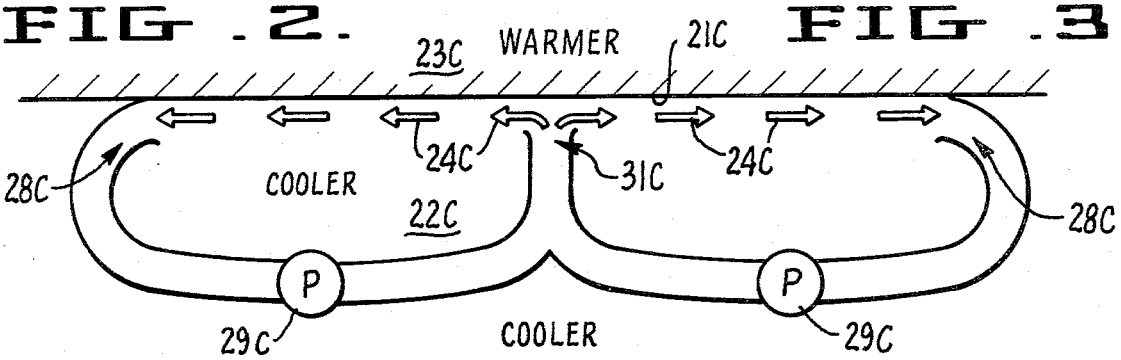
FIG. 4 is a diagramatic cross-sectional view illustrating a horizontal interface between a solid and a liquid under the influence of forces other than gravity.

The heat transfer reducing principle of the present invention can also be used with horizontal surfaces. As depicted schematically in FIG. 4 of the drawings, the boundary layer of fluid at a horizontally extending interface 21C, between a warmer solid body 23C and a subjacent cooler fluid body 22C, will become heated and accordingly less dense than the average density of the body of fluid. Forces acting in the direction of arrows 24C to urge the heated layer of fluid along the interface 21C create the desired movement of the heated fluid across the interface. The heated fluid is intercepted at 28C and returned via pump means 29C to be distributed back onto the interface at 31C.

Where the fluid body 22C is warmer than the solid body 23C, the positions shown in FIG. 4 will be reversed with the fluid body 22C above and the solid body 23C below the interface 21C.

As will be apparent, the forces acting on the fluid layer subject to warming or cooling because of heat transfer across the interface may be forces other than gravity, so long as these forces act on the body of fluid in the desired direction and with the described varying effect in accordance with the temperature of the fluid.

The present invention is particularly valuable in reducing heat transfer from one fluid body to another fluid body through a solid barrier of thermally conductive material. This is especially true where the fluid of at least one of the fluid bodies changes in density in response to localized changes in temperature, that is, the boundary layer of fluid at the barrier becomes more or less dense than the surrounding fluid in accordance with heat transfer through the barrier away from or into the boundary layer of fluid. Many forces, particularly gravitional and inertial forces. exert more effect on denser fluid and less effect on less dense fluid.

Where gravitional forces are involved, the denser fluid tends to sink through the fluid body and the less dense fluid tends to rise, this process being known as "convection." These natural convection forces are utilized to move the boundary layer of fluid upwardly or downwardly along the barrier, and the moving layer of fluid is collected and again discharged against the barrier for repeated upward of downward movement therealong. In this manner, a layer of fluid is continually provided at the barrier which has absorbed or given up heat energy across the barrier and is nearer the temperature on the other side of the barrier than is the main body of fluid.

The barrier between the adjacent fluid bodies will normally comprise a relatively thin sheet of thermally conductive material prone to transfer heat energy from the warmer body to the cooler body. Accordingly, the barrier may be formed of metal, plastics, or other materials, including glass and may be in the form of a panel, wall structure or window through a wall structure.

Figure 5:
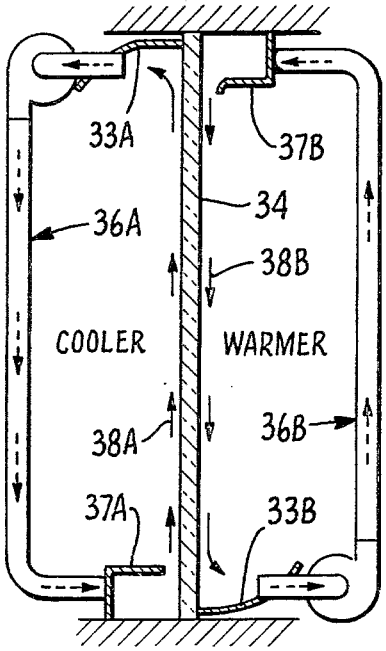
FIG. 5 is a vertical cross-sectional view of a window or panel having heat transfer reducing means constructed in accordance with the present invention and illustrated in simplified, schematic depiction.

A typical installation for controlling heat transfer through a window pane is illustrated in FIG. 5 of the drawings. As there shown, a downwardly opening collector trough 33A is mounted near the top of the cooler side of a window pane 34, and an upwardly opening collector trough 33B is mounted near the bottom of the opposite, warmer side of pane 34. Recirculating means 36A draws air from the trough 33A and supplies such air to distributor 37A located near the bottom of the same, cooler, side of window 34. Likewise, recirculating means 36B draws air from collector trough 33B and supplies such air to a distributor 37B positioned near the top of the same, warmer, side of window pane 34. Collector 33A is thus positioned on the cooler side of pane 34 in position to receive the boundary layer of air on that side, adjacent to pane 34. This boundary layer of air becomes less dense by heat transfer through pane 34 from the warmer side, and the less dense air rises along pane 34 in the path indicated by arrows 38A.

On the warmer side of the window, collector trough 33B is positioned to receive the downwardly flowing boundary layer or air adjacent to pane 34, which moves downwardly along path 38B by reason of increased density caused by heat transfer from such layer through pane 34 to the cooler side of the window.

Figure 6:
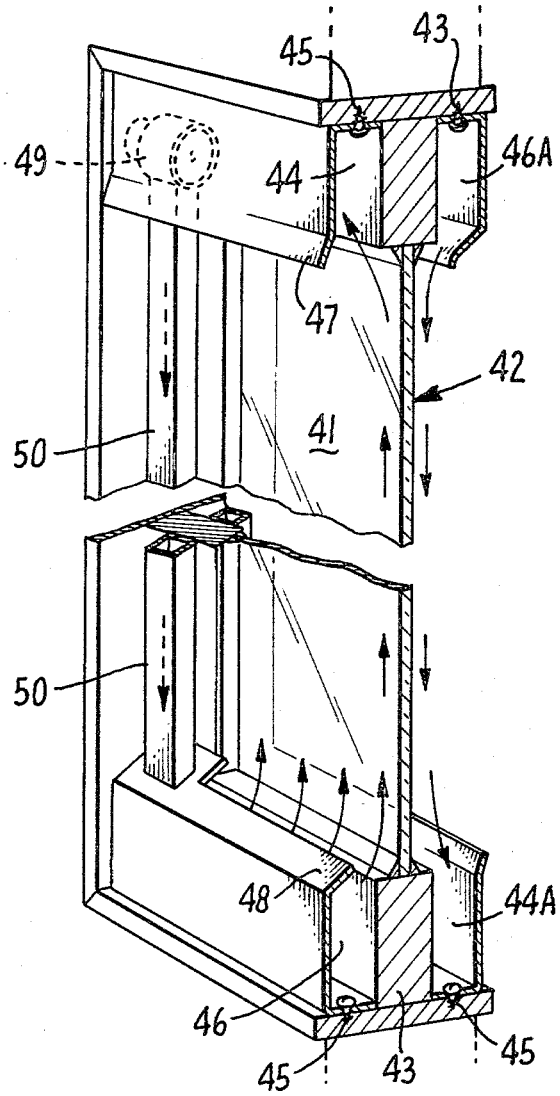
FIG. 6 is a perspective view of a window structure, in accordance with the present invention, with portions being broken away and shown in section to reveal internal construction.

The apparatus of the present invention is well adapted for relatively inexpensive retrofit to existing window structures. As illustrated in FIG. 6 of the drawings, an existing window structure 41 having a pane 42 mounted in a sash 43 is provided with apparatus constructed in accordance with the present invention. As there shown, a collecting trough 44 is mounted against and utilizes one face of the upper run of sash 43, while a distributor 46 is mounted against and utilizes one face of the lower run of sash 43.

Preferably, the outer lip of trough 44 is flared outwardly as shown to funnel the upwardly moving layer of air into the trough, and the distributor 46 is provided with an inturned lip for discharging the collected air against pane 42. The collected air is moved from trough 44 by a motor driven fan through conduit 50 to the distributor 46. A collector trough 44A, similar to collector trough 44, is mounted along the lower run of sash 43, and a distributor 46A, similar to distributor 46, but inverted, is mounted along the upper run of sash 43. The downwardly moving layer of air collected in trough 44A is pumped upwardly toward distributor 46A by a motor driven fan and conduit (not shown) similar to fan 49 and conduit 50, but inverted.

Figure 7:
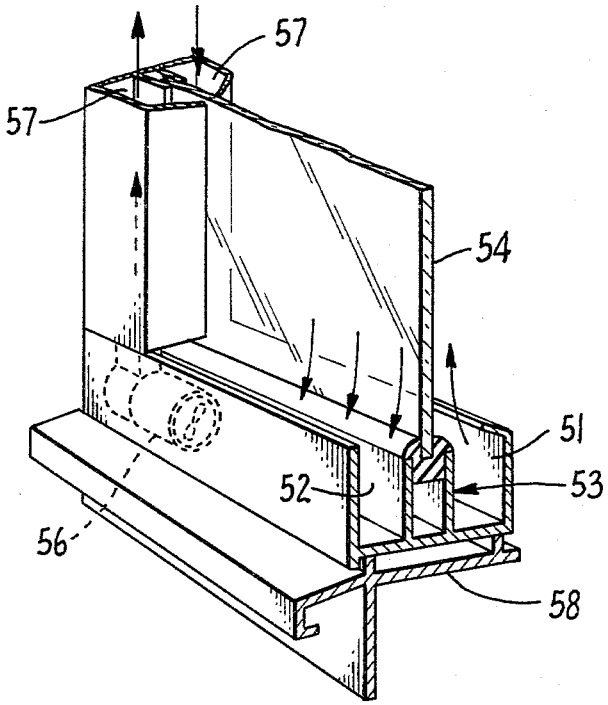
FIG. 7 is a view similar to the lower protion of FIG. 6, but illustrating a modified form of the invention.

The apparatus of the present invention is also well suited for original installations. A modified form of the invention for use in original installations is illustrated in FIG. 7 of the drawings, representing the corner portion of a window structure. Here, a distributor trough 51 and collector trough 52 are provided by a single extrusion member 53, which also provides a sash for mounting of a windowpane 54. A motor driven fan assembly 56, or the like, is concealed in collector trough 52 and supplies air therefrom through a conduit 57 to the associated distributor (not shown) on the same side.

In FIG. 6 of the drawings, the cooler air is on the same side of pane 42 as is collector 44, and the warmer air is assumed to be on the opposite side. Assuming the cooler air is inside and the warmer air is outside, as would normally be the case in the summertime when airconditioning is used, the relative positions of the collector trough 44 and distributor 46 must necessarily be reversed in the wintertime when the heated air is inside and the colder air is outside. In the form of the invention illustrated in FIG. 6 of the drawings, the collector troughs and distributors are removably secured in place, as by screws 45, so that the unit may be removed from its position against the window and either inverted, or moved to the other side of the window.

In the form of the invention shown in FIG. 7 of the drawings, the entire window and sash assembly, providing the collector and distributor, may be bodily removed from its opening in the frame 58 and either inverted or rotated 180° about a vertical axis and reinserted into the opening.

Where the horizontal extent of the window is rather long, as in the case of plate glass display windows and picture windows, several units may be manifolded together to be operated from a single fan. This eliminates problems caused by the physical restrictions of fluid flow in a conduit or trough, which would otherwise limit the useful length of single collectors and/or distributors.

Figure 8:
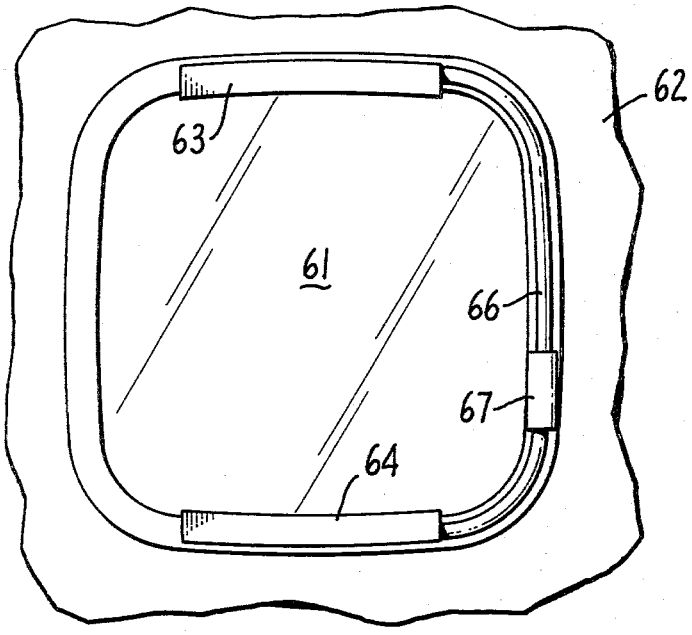
FIG. 8 is a front elevational view of a window constructed in accordance with the present invention.
Figure 9:
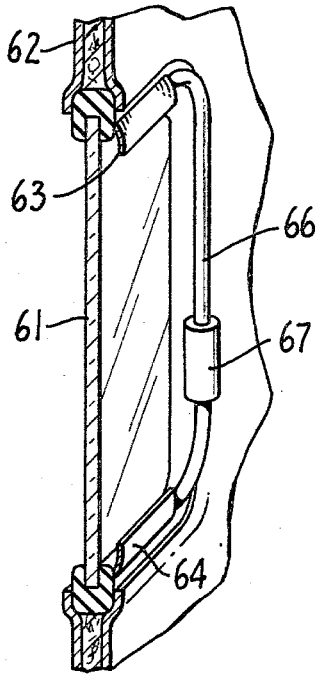
FIG. 9 is a perspective view of the window of FIG. 8, with portions being broken away and shown in section to reveal internal construction.

The apparatus of the present invention also is particularly useful for reducing heat transfer through the windows of various types of transport craft such as submarines, ships, boats, land vehicles, aircraft and space craft. A typical window construction for such transport craft is illustrated in FIGS. 8 and 9 of the drawings. As there shown, the windowpane 61 is mounted in an insulated wall structure 62. However, it should be apparent that the walls also could be without substantial installation, and apparatus according to the present invention could be applied to desired expanses of such walls.

As illustrated in FIGS. 8 and 9, a distributor 63 is mounted along the upper edge of pane 61, and a collector trough 64 is mounted along the lower edge to receive the boundary layer of air passing downwardly along pane 61 by natural convection caused by heat loss from the boundary layer through pane 61 to the exterior of the craft. The collected cooled, denser air is recirculated from collector trough 64 to distributor 63 through a conduit 66 in which is interposed a suitable fan or air pump 67.

In those instances wherein the interior of the craft is to be maintained at a cooler temperature than the exterior, as in desert vehicles, the unit is inverted so that distributor 63 runs along the bottom edge of the window and collector trough 64 along the upper edge.

As illustrated in FIGS. 5 through 9 of the drawings, the windowpane extends substantially vertically. In certain situations, the convecting fluid may tend to be transported away from the constraining surface by a stronger fluid motion. For example, if a collector and distributor assembly were installed on the outside of the building window, at times the wind would render it less effective, even though a symmetric (inverted) unit installed on the inside would remain effective.

In these situations, where wind or other fluid motion tends to strip the boundary convection layer away from the surface, greater control of heat transfer through such surface can be obtained by intentional inclination of such surface. As described in connection with FIGS. 2 and 3 of the drawings, the upper edge of the inclined surface must necessarily be tilted in the direction of the cooler body of fluid so that the warmed layer of fluid will tend to rise against the surface and the cooled boundary layer of fluid will tend to sink against the surface.

Figure 10:
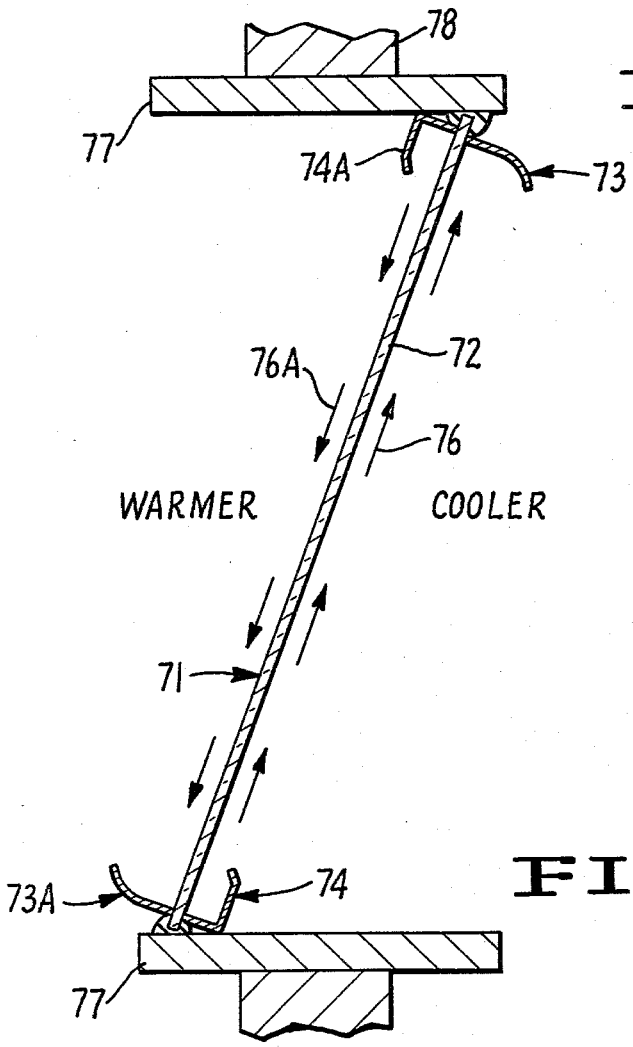
FIG. 10 is a vertical cross-sectional view of an inclined window structure constructed in accordance with the present invention.

A typical installation for a building window, taking advantage of the described advantages of intentionally inclining the heat transfer surfaces, is illustrated in FIG. 10 of the drawings. As there shown, the window assembly 71 has an inclined windowpane 72, with a collector trough 73 at the upper edge of the pane 72 on the cooler side, and a distributor trough extending along the lower edge of pane 72, also on the cooler side. On the warmer side, the collector trough 73A is mounted along the lower edge of pane 72 and the distributor 74A is mounted along the upper edge.

The structure of FIG. 10 is also adapted for conversion when the relative temperatures of the bodies of air it separates are reversed. For this purpose, pane 72 is mounted in a frame 77 which is formed for removal from an opening in wall 78 and for reinsertion into such opening after the unit has been rotated 180° around a vertical axis.

Figure 11:
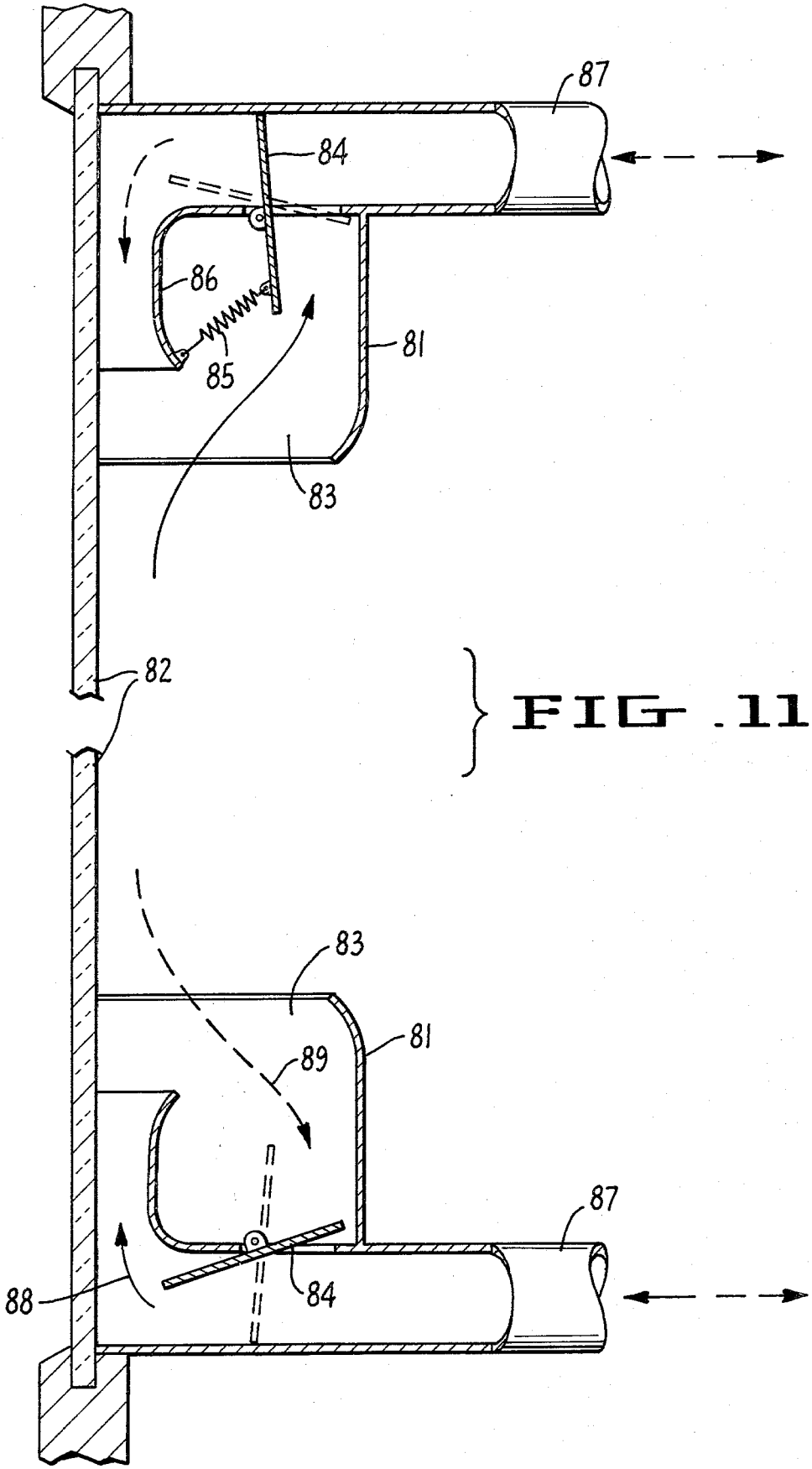
FIG. 11 is a fragmentary vertical cross-sectional view of a modified form of the invention showing a combination collector-distributor structure.

A modified form of the invention is illustrated in FIG. 11 of the drawings in which the same structure is permanently mounted in place and automatically adapts itself to act either as a collector trough or as a distributor. For this purpose, a generally vertically extending wall 81 is mounted in spaced relation to a windowpane 82 along the lower edge thereof to define a trough 83. Pivotally mounted to extend along trough 83 is a flap valve 84, to which is attached a longitudinally extending, upwardly curving member 86. A conduit 87 communicates with trough 83 for alternatively supplying air and removing air.

When in the distributor mode, with air being supplied to trough 83 through conduit 87, the force of such air swings valve member 84 and associated member 86 to the position illustrated in full lines in FIG. 11. In this position, the air is forced through a comparatively narrow slot between member 86 and windowpane 82 to assist in limiting the thickness of the convection boundary layer.

When in the collecting mode, with the collected air being removed from trough 83 through conduit 87, either gravity or a spring 85 moves the valve member 84 to the position shown in dotted lines in FIG. 11 of the drawings. In this position, the collected air is free to flow down to the bottom of trough 83 for removal through conduit 87.

A similar dual purpose collector-distributor with flow activated valve can be utilized at the top of the window and functions automatically in a similar manner. With such an installation at both the top and bottom of the window, connected by a recirculating means (not shown), it is only necessary to reverse the direction of air flow through the conduits 87 in order to convert the device from collector to distributor and vice versa.

In view of the foregoing, it will be seen that the method and apparatus of the present invention provides a novel way of reducing the transfer of heat across an interface between a fluid body and an adjacent body. The method and apparatus of the present invention are particularly suited for controlling unwanted heat loss from the interior of a structure and unwanted heat acquisition into the interior of the structure, the invention having particular reference to heat control through high conductivity windows, panels, and the like.

What is claimed is:

1. Apparatus for reducing the rate of heat transfer across an interface forming a common boundary for a fluid body and another body and which constrains the flow of fluid body across said common boundary interface, comprising collector means positioned at a side of an expanse of said interface for collecting fluid displaced along said interface by forces acting on said fluid body in the direction of said collector means, recirculating means for removing the collected fluid from said collection means, and distributor means formed for receiving said collected fluid and discharging same at the other side of said expanse of said interface, heat transfer through said interface causing the effect of said forces on the portion of said fluid body adjacent said interface whereby the discharged collected fluid is displaced along said expanse to said collection means.

2. Apparatus as described in claim 1, and wherein said interface is a common boundary between a fluid body and a solid body.

3. Apparatus as described in claim 2, and wherein said solid body is a barrier between said fluid body and a second fluid body.

4. Apparatus as described in claim 3, and wherein said barrier is a thin sheet of thermally conductive material, and the fluid of at least one of said fluid bodies changes in density in response to changes in temperature.

5. Apparatus as described in claim 4, and wherein said fluid which changes in density in response to changes in temperature is air.

6. Apparatus as described in claim 5, and wherein said expanse of said interface is generally other than horizontal.

7. Apparatus as described in claim 6, and wherein said collector means is positioned at the higher side of said expanse of said interface.

8. Apparatus as described in claim 6, and wherein said collector means is positioned at the lower side of said expanse of said interface.

9. Apparatus as described in claim 5, and wherein said barrier is at least partly transparent so as to provide window means.

10. Apparatus as described in claim 4, and wherein the fluid of both of said fluid bodies changes in density in response to localized changes in temperature at said barrier, and said collector means and said distributor means are mounted at both faces of said barrier.

11. Apparatus for reducing the rate of heat transfer from a constrained heat loss surface to a fluid in contact therewith, comprising a collector mounted adjacent to the heat loss surface and formed for intercepting fluid displaced along said surface by forces acting in the direction of said collector in accordance with heat loss from said surface into said fluid, a distributor mounted adjacent to said heat loss surface in spaced relation to said collector and formed for discharging fluid for displacement along said surface to said collector, and recirculating means formed for removing fluid from said collector and supplying such fluid to said distributor.

12. Apparatus as described in claim 11, and wherein said heat loss surface is provided by a relatively thin barrier between adjacent fluid bodies of differing temperatures.

13. Apparatus as described in claim 12, and wherein said adjacent fluid bodies are gaseous.

14. Apparatus as described in claim 13, and wherein said adjacent fluid bodies are air.

15. Apparatus as described in claim 14, and wherein said adjacent fluid bodies are indoor air and outdoor air.

16. Apparatus as described in claim 15, and wherein said barrier comprises a window.

17. Apparatus as described in claim 11, and wherein said heat loss surface is provided by a relatively thin barrier between a fluid body and a substantial vacuum.

18. Apparatus as described in claim 17, and wherein said fluid is air.

19. Apparatus as described in claim 18, and wherein said barrier comprises a window for a spacecraft.

20. Apparatus as described in claim 17, and wherein one of said fluid bodies is gaseous, and the other of said fluid bodies is liquid.

21. Apparatus as described in claim 20, and wherein said heat loss surface is provided by a relatively thin barrier between the interior of a transport vessel and a liquid.

22. Apparatus as claimed in claim 21, and wherein said barrier comprises a window for a submersible craft.

23. In a structure having a sheet of heat conductive material separating fluid bodies of differing temperatures, apparatus for reducing the rate of heat transfer through said sheet, comprising collector means positioned along and adjacent to a selected expanse of said sheet for collecting fluid displaced therealong by forces acting on the portion of one of said fluid bodies adjacent to said sheet in the direction of said collector means by reason of heat transfer through said sheet from the other of said bodies, recirculating means for removing the collected fluid from said collector means, and distributor means connected to receive the collected fluid from said recirculating means and formed for discharging said collected fluid along said expanse of sheet for repeated displacement thereacross and into said collector means so as to reduce the temperature differential between the layers of fluid at the opposite sides of said sheet.

24. Apparatus as described in claim 23, and wherein said sheet is other than horizontal, and said collector means is positioned in the warmer of said fluid bodies and includes a trough formed to open upwardly for receiving fluid moving downwardly along said expanse of sheet by reason of greater density than the surrounding fluid, such greater density resulting from heat transfer through said sheet of heat conductive material to the cooler fluid body on the other side.

25. Apparatus as described in claim 24, and wherein said distributor means extends generally horizontally along the higher edge of said expanse of sheet, and said collector means trough extends generally horizontally along the lower edge of said expanse.

26. Apparatus as described in claim 23, and wherein said fluid bodies are air, and said sheet of heat conductive material comprises a window pane.

27. Apparatus as described in claim 23, and wherein said collector means is positioned in the cooler of said fluid bodies and includes a trough formed to open downwardly for receiving fluid moving upwardly along said expanse of sheet by reason of lesser density than the surrounding fluid, such lesser density resulting from heat transfer through said sheet of heat conductive material from the warmer fluid body on the other side.

28. Apparatus as described in claim 27, and wherein said distributor means extends generally horizontally along the lower edge of said expanse of sheet, and said collector means trough extends generally horizontally along the upper edge of said expanse.

29. Apparatus as described in claim 24, and wherein said fluid bodies are air, and said sheet of heat conductive material comprises a window pane.

30. Apparatus as described in claim 27, and wherein said fluid bodies are air, and said sheet of heat conductive material comprises a window pane.

31. In a structure having a non-horizontally disposed sheet of heat conductive material separating fluid bodies of differing temperatures, apparatus for reducing the rate of heat transfer through said sheet, comprising collector means positioned generally horizontally along and adjacent to said sheet on both sides thereof for collecting fluid displaced along an expanse of said sheet by convection resulting from density differential between the fluid adjacent said sheet and the surrounding fluid, said collector means on the side of said sheet in the warmer of said fluid bodies including a trough formed to open upwardly for receiving fluid moving downwardly along said expanse of sheet by reason of greater density than the surrounding fluid, said greater density resulting from heat transfer through said sheet of heat conductive material to the cooler fluid body on the other side, said collector means on the side of said sheet in the cooler of said fluid bodies including a trough formed to open downwardly for receiving fluid moving upwardly along said expanse of sheet by reason of lesser density than the surrounding fluid, said lesser density resulting from heat transfer through said sheet of heat conductive material from the warmer fluid body on the other side, pump means on each side of said sheet for removing the collected fluid from said trough means on such side, and a distributor means on each side of said sheet connected to said pump means on the same side and positioned along said expanse of said sheet in vertically spaced relation to said trough means on the same side, each of said distributor means being formed for discharging said collected fluid along said expanse of sheet for displacement thereacross and back into the trough means on the same side so as to reduce the temperature differential between the layers of fluid at the opposite sides of said sheet, said distributor means on the side of said sheet in the warmer of said fluid bodies extending generally horizontally along the lower edge of said expanse, and said distributor means on the side of said sheet in the cooler of said bodies extending generally horizontally along the higher edge of said expanse.

32. Apparatus as described in claim 31, and wherein said fluid bodies are air, and said sheet of heat conductive material comprises a window pane.

33. A window structure having apparatus for reducing the rate of heat transfer therethrough, comprising a window pane, a sash supporting said window pane across an opening in a building structure whereby said pane has an inner face contacting the air contained in said building structure and an outer face contacting the outside air, a collector mounted to extend generally horizontally along the lower edge of the inner face of said pane for collecting air displaced downwardly along the inner face of said pane by reason of greater density than the surrounding air resulting from heat transfer through said pane to cooler outside air, a distributor mounted generally horizontally along the upper edge of the inner face of said pane, and air recirculating means having a power driven fan operatively mounted in a conduit connecting said collector to said distributor and formed for removing the denser air from said collector and supplying such denser air through said distributor to pass downwardly along the inner face of said pane and back into said collector.

34. A structure as described in claim 33, and wherein means is provided for inverting said apparatus for selectively positioning said collector along the upper and lower edges of the inner face of said pane and for correspondingly selectively positioning said distributor along the lower and upper edges of the inner face of said pane.

35. A window structure having apparatus for reducing the rate of heat transfer therethrough comprising a window pane, a sash supporting said window pane across an opening in a building structure whereby said pane has an inner face contacting the air contained in said building structure and an outer face contacting the outside air, a collector mounted to extend generally horizontally along the upper edge of the outer face of said pane for collecting air displaced upwardly along the outer face of said pane by reason of lesser density than the surrounding air resulting from heat transfer through said pane from warmer inside air, a distributor mounted generally horizontally along the lower edge of the outer face of said pane, and air recirculating means having a power driven fan operatively mounted in a conduit connecting said collector to said distributor and formed for removing the less dense air from said collector and supplying such air of lesser density through said distributor to pass upwardly along the outer face of said pane and back into said collector.

36. A structure as described in claim 35, and wherein means is provided for inverting said apparatus for selectively positioning said collector along the lower and upper edges of the outer face of said pane, and for correspondingly selectively positioning said distributor along the lower and upper edges of the outer face of said pane.

37. In a structure having a sheet of heat conductive material inclined with respect to the horizontal and separating fluid bodies of differing temperatures, apparatus for reducing the rate of heat transfer through said sheet, comprising collector means positioned generally horizontally along and adjacent to said sheet for collecting fluid displaced generally upwardly or downwardly along an expanse of said sheet by density differential between the fluid adjacent said sheet and the surrounding fluid caused by heat transfer through said sheet, recirculating means for removing the collected fluid from said collector means, and distributor means connected to receive the collected fluid from said recirculating means and formed for discharging said collected fluid along said expanse of sheet for displacement in response to said density differential generally upwardly or downwardly thereacross and into said collector means so as to reduce the temperature differential between the layers of fluid at the opposite sides of said sheet.

38. Apparatus as described in claim 37, and wherein said collector means is positioned in the warmer of said fluid bodies and includes a trough formed to open upwardly for receiving fluid moving downwardly along said expanse of sheet by reason of greater density than the surrounding fluid, such greater density resulting from heat transfer through said sheet of heat conductive material to the cooler fluid body on the other side.

39. Apparatus as described in claim 38, and wherein said distributor means extends generally horizontally along the higher edge of said expanse of sheet, and said collector means trough extends generally horizontally along the lower edge of said expanse.

40. Apparatus as described in claim 38, and wherein said fluid bodies are air, and said sheet of heat conductive material comprises a window pane.

41. Apparatus as described in claim 37, and wherein said collector means is positioned in the cooler of said fluid bodies and includes a trough formed to open downwardly for receiving fluid moving upwardly along said expanse of sheet by reason of lesser density than the surrounding fluid, such lesser density resulting from heat transfer through said sheet of heat conductive material from the warmer fluid body on the other side, said sheet being inclined with its upper edge tilted in the direction of said cooler body of fluid whereby said fluid of lesser density tends to rise against the undersurface of said inclined sheet.

42. Apparatus as described in claim 37, and wherein said distributor means is positioned in the warmer of said fluid bodies and extends generally horizontally along the higher edge of side expanse of sheet for discharging fluid to move downwardly along said expanse of sheet by reason of greater density than the surrounding fluid, such greater density resulting from heat transfer through said sheet toward the cooler fluid body on the other side, and said collector means trough extends generally horizontally along the lower edge of said expanse, said sheet being inclined with its upper edge tilted in the direction of the cooler body of fluid whereby said fluid of lesser density tends to sink downwardly along the upper surface of said inclined sheet.

43. Apparatus as described in claim 41 or 42, and wherein said fluid bodies are air, and said sheet of heat conductive material comprises a window pane.

44. Apparatus as described in claim 42, and wherein said fluid bodies are indoor and outdoor air, and said sheet of heat conductive material comprises a window pane.

45. In a structure having a substantially vertically disposed sheet of heat conductive material separating fluid bodies of differing temperatures, apparatus for reducing the rate of heat transfer said sheet, comprising collector means positioned generally horizontally along and adjacent to said sheet for collecting fluid displaced generally vertically along an expanse of said sheet by density differential between the fluid adjacent said sheet and the surrounding fluid caused by heat transfer through said sheet, recirculating means for removing the collected fluid from said collector means, and distributor means formed to receive the collected fluid from said recirculating means and to discharge said collected fluid along said expanse of sheet for generally vertical displacement thereacross in response to said density differential and into said collector means so as to reduce the temperature differential between the layers of fluid at the opposite sides of said sheet.

46. Apparatus as described in claim 45, and wherein said collector means is positioned in the warmer of said fluid bodies and includes a trough formed to open upwardly for receiving fluid moving vertically downwardly along said expanse of sheet by reason of greater density than the surrounding fluid, such greater density resulting from heat transfer through said sheet of heat conductive material to the cooler fluid body on the other side.

47. Apparatus as described in claim 46, and wherein said distributor means extends generally horizontally along the upper edge of said expanse of sheet, and said collector means trough extends generally horizontally along the lower edge of said expanse.

48. Apparatus as described in claim 47, and wherein said fluid bodies are air, and said sheet of heat conductive material comprises a window pane.

49. Apparatus as described in claim 45, but wherein said collector means is positioned in the cooler of said fluid bodies and includes a trough formed to open downwardly for receiving fluid moving vertically upwardly along said expanse of sheet by reason of lesser density than the surrounding fluid, such lesser density resulting from heat transfer through said sheet of heat conductive material to the warmer fluid body on the other side.

50. Apparatus as described in claim 49, and wherein said distributor means extends generally horizontally along the lower edge of said expanse of sheet, and said collector means trough extends generally horizontally along the upper edge of said expanse.

51. Apparatus as described in claim 49, and wherein said fluid bodies are air, and said sheet of heat conductive material comprises a window pane.

52. In a structure having a non-horizontally disposed sheet of heat conductive material separating fluid bodies of differing temperatures, apparatus for reducing the rate of heat transfer through said sheet, comprising collector means positioned generally horizontally along and adjacent to said sheet on both sides thereof for collecting fluid displaced upwardly or downwardly along an expanse of said sheet by density differential between the fluid adjacent said sheet and the surrounding fluid, said collector means on the side of said sheet in the warmer of said fluid bodies including a trough formed to open upwardly for receiving fluid moving downwardly along said expanse of sheet by reason of greater density than the surrounding fluid, said greater density resulting from the chilling effect on the boundary layer of fluid resulting from heat transfer through said sheet of heat conductive material to the cooler fluid body on the other side, said collector means on the side of said sheet in the cooler of said fluid bodies including a trough formed to open downwardly for receiving fluid moving upwardly along said expanse of sheet by reason of lesser density than the surrounding fluid, said lesser density resulting from the warming effect on the boundary layer of fluid resulting from heat transfer through said sheet of heat conductive material from the warmer fluid body on the other side, pump means for removing the collected fluid from said collecting means troughs, and distributor means connected to said pump means and positioned along and adjacent to said sheet on both sides thereof in vertically spaced relation to said collector means troughs, said distributor means being formed for discharging said collected fluid along said expanse of sheet for displacement thereacross and back into the trough on the same side so as to reduce the temperature differential between the layers of fluid at the opposite sides of said sheet, said distributor means on the side of said sheet in the warmer of said fluid bodies extending horizontally along the uper edge of said expanse, and said distributor means on the side of said sheet in the cooler of said bodies extending horizontally along the lower edge of said expanse.

53. A window structure having apparatus for reducing the rate of heat transfer therethrough, comprising a window pane, a frame supporting said window pane to extend non-horizontally across an opening in a wall structure whereby said pane has an inner face contacting air contained by said wall structure, a collector mounted to extend generally horizontally along the lower edge of the inner face of said pane for collecting air displaced downwardly along the inner face of said pane by reason of greater density resulting from heat transfer through said pane to the outside, a distributor mounted generally horizontally along the upper edge of the inner face of said pane, and air recirculating means having a power driven fan operatively mounted in a conduit connecting said collector to said distributor and formed for removing the denser air from said collector and supplying such senser air through said distributor to pass downwardly along the inner face of said pane and back into said collector.

54. A window structure having apparatus for reducing the rate of heat transfer therethrough comprising a window pane, a frame supporting said window pane to extend non-horizontally across an opening in a wall structure whereby said pane has an inner face contacting air contained by said wall structure, a collector mounted to extend generally horizontally along the upper edge of the inner face of said pane for collecting air displaced upwardly along the inner face of said pane by reason of lesser density than the surrounding air resulting from heat transfer through said pane from a warmer outside environment, a distributor mounted generally horizontally along the lower edge of the inner face of said pane, air recirculating means having a power driven fan operatively mounted in a conduit connecting said collector to said distributor and formed for removing the less dense air from said collector and supplying such air of lesser density through said distributor to pass upwardly along the inner face of said pane and back into said collector, and means for repositioning said frame so that said collector extends along the lower edge of said pane and said distributor extends along the upper edge of said pane when the air outside the pane is colder than that inside.

55. A window structure as described in claim 54, and wherein said frame is selectively invertable in said opening for reversing the positioning of said distributor and said collector.

56. A window structure as described in claim 54, and wherein a collector and a distributor are mounted at both faces of said pane with the collector at one face being at the upper edge and the collector at the other face being at the lower edge, and said frame is formed for rotation of said pane 180° about a vertical axis for reversing the relative positioning of said distributors and collectors at both the inside and outside faces of the window.

57. A window structure having apparatus for reducing the rate of heat transfer therethrough, comprising a window pane, a sash supporting said window pane across an opening in a building structure whereby said pane has an inner face contacting the air contained in said building structure and an outer face contacting the outside air, a collector mounted to extend generally horizontally along the lower edge of the outer face of said pane for collecting air displaced downwardly along the outer face of said pane by reason of greater density than the surrounding air resulting from heat transfer through said pane to cooler inside air as during air conditioning, a distributor mounted generally horizontally along the upper edge of the outer face of said pane, and air recirculating means having a power driven fan operatively mounted in a conduit connecting said collector to said distributor and formed for removing the denser air from said collector and supplying such denser air through said distributor to pass downwardly along the outer face of said pane and back into said collector.

58. A window structure having apparatus for reducing the rate of heat transfer therethrough, comprising a window pane, a frame supporting said window pane to extend non-horizontally across an opening in a wall structure whereby said pane has an inner face contacting air contained by said wall structure, a collector mounted to extend generally horizontally along the upper edge of the inner face of said pane for collecting air displaced upwardly along the inner face of said pane by reason of lesser density resulting from heat transfer to said pane from the outside, a distributor mounted generally horizontally along the lower edge of the inner face of said pane, and air recirculating means having a power driven fan operatively mounted in a conduit connecting said collector to said distributor and formed for removing the less dense air from said collector and supplying such less dense air through said distributor to pass upwardly along the inner face of said pane and back into said collector.

59. The method of reducing the rate of heat transfer across an interface forming a common boundary for a fluid body and another body which constrains the flow of fluid body across said common boundary interface, comprising the steps of collecting at one side of an expense of said interface fluid displaced along said expanse by forces acting on said fluid in the direction of said side, transporting the collected fluid to the other side of said expanse, and discharging the collected fluid at said other side of said expanse for repeated displacement across said expanse to said collector.

60. The method of reducing the rate of heat transfer from a constrained heat loss surface to a fluid in contact therewith, comprising the steps of intercepting fluid displaced along the heat loss surface by forces acting on the layer of fluid adjacent to such surface, and discharging the collected fluid for repeated displacement along said heat loss surface

61. The method of reducing the rate of heat transfer from a warmer body of fluid to a cooler solid body, comprising the steps of intercepting fluid displaced along the interface between said bodies by forces acting on the cooled layer of fluid adjacent to said interface, and discharging the collected cooled fluid for repeated displacement along said interface whereby the temperature gradient between said bodies is reduced.

62. The method according to claim 61, and wherein said solid body is a thin barrier of heat conducting material between fluid bodies of differing temperatures.

63. The method of reducing the rate of heat transfer from a warmer solid body to a cooler fluid body, comprising the steps of intercepting fluid displaced along the interface between said bodies by forces acting on the layer of warmed fluid adjacent to said interface, and discharging the collected warmed fluid for repeated displacement along said interface whereby the temperature gradient between said bodies is reduced.

64. The method according to claim 63, and wherein said solid body is a thin barrier of heat conductive material between fluid bodies of differing temperatures.

* * * * *